US005974635A

United States Patent [19]

Murasaki

[11] Patent Number: 5,974,635

[45] Date of Patent: Nov. 2, 1999

[54] FEMALE ENGAGING MEMBER OF SURFACE FASTENER AND METHOD OF MANUFACTURING THE SAME

[75] Inventor: Ryuichi Murasaki, Toyama-ken, Japan

[73] Assignee: YKK Corporation, Tokyo, Japan

[21] Appl. No.: 09/129,091

[22] Filed: Aug. 5, 1998

[30] Foreign Application Priority Data

Aug. 5, 1997 [JP] Japan ..... 9-210357

[51] Int. Cl.[6] ..... A44B 18/00

[52] U.S. Cl. ..... 24/446; 24/442; 24/445; 24/452

[58] Field of Search ..... 24/446, 447, 449, 24/451, 452, 445, 442

[56] References Cited

U.S. PATENT DOCUMENTS

| | | | |
|---|---|---|---|
| 3,387,345 | 6/1968 | Savoir | 24/446 |
| 3,943,981 | 3/1976 | De Brabander | 24/445 |
| 5,179,767 | 1/1993 | Allan | 24/442 |
| 5,512,234 | 4/1996 | Takizawa et al. | 264/511 |
| 5,620,769 | 4/1997 | Wessels et al. | 24/452 |
| 5,659,930 | 8/1997 | Okawa | 24/446 |
| 5,745,961 | 5/1998 | Okawa et al. | 24/446 |

*Primary Examiner*—Victor N. Sakran
*Attorney, Agent, or Firm*—Hill & Simpson

[57] ABSTRACT

The invention relates to a female engaging member for a surface fastener carrying engaging elements which has a novel profile and a method of manufacturing a surface fastener which is adapted to continuous manufacturing operation by means of a relatively simple process without requiring serious maintenance efforts. The method will allow to select appropriate engaging force and anti-separation force for the surface fastener. The engaging member for a surface fastener comprises a flat plate-like substrate and a large number of pile-shaped engaging elements arranged on the surface thereof. The pile-shaped engaging elements are made of filaments wound around core threads and thus continuous manufacturing by simple operation is realized. A winding of the filament wound around the core thread has a length greater than that of the outer periphery of the core thread. When the pile-shaped engaging elements are firmly attached to the surface of the flat plate-like substrate, the largest gap D between the inner surface of each filament and the peripheral surface of the corresponding core thread is defined by 0.1 mm≦D≦5 mm. With the above arrangement, pile-shaped engaging elements with different sizes can be manufactured easily to contribute to wide variety of applications.

25 Claims, 7 Drawing Sheets

FEMALE ENGAGING MEMBER OF SURFACE FASTENER AND METHOD OF MANUFACTURING THE SAME

BACKGROUND OF THE INVENTION

1. Field of the Invention

This invention relates to a female engaging member of a surface fastener made of a thermoplastic synthetic resin material and comprising a flat plate-like substrate and a large number of pile-shaped engaging elements arranged on the surface of the substrate as well as to a method of manufacturing such a female engaging member. More particularly, the present invention relates to a female engaging member of a surface fastener adapted to be manufactured efficiently and continuously in a single step and showing excellent engagement strength and peeling strength relative to a mating male engaging member, both the substrate and the pile-shaped engaging elements being adapted to be made of an appropriate material suitable for the application and selected out of a variety of different materials. Male engaging elements realized in a mushroom-shaped or hook-shaped form or in some other form may be arranged on the front or rear surface of the substrate. The present invention also provides a method of manufacturing such a female engaging member.

2. Prior Art

Generally, a known surface fastener comprises a male engaging member having a flat plate-like substrate and a large number of anchor-shaped or mushroom-shaped male engaging elements arranged on the substrate and a female engaging member also having a flat plate-like substrate and a large number of pile-shaped female engaging elements arranged on the substrate so that they may be brought into mutual engagement over the entire surface thereof when their substrates are placed oppositely and pressed against relative to each other and the engaged male and female members may be separated from each other when they are pulled from each other. Therefore, a surface fastener is generally used as an article composed of members having two structures. Alternatively, male and female engaging elements may be arranged on a same side or on the opposite sides of one flat plate-like substrate.

Male engaging elements having various different profiles such as hook-shaped, mushroom-shaped or palm tree-shaped are currently used. The male engaging elements of a surface fastener are typically produced by preparing a sheet of knit or woven fabric that contains a large number of looped monofilaments and then cutting the looped monofilaments of the fabric. Alternatively, the male engaging elements of a surface fastener may be prepared integrally with the flat plate-like substrate by introducing a molten resin material onto a die wheel having a large number of engaging-elements-forming cavities on the peripheral surface thereof, while rotating the die wheel in one direction.

On the other hand, female engaging elements are typically realized in the form of densely arranged piles of fibers. Thus, a female engaging member is generally produced by preparing a sheet of knit, woven or non-woven fabric or synthetic resin as substrate thereof that carries a large number of piles of fibers on the surface. The piles of fibers are normally produced at the time of knitting or weaving the fibrous flat plate-like substrate as integral part of thereof. U.S. Pat. No. 5,512,234 discloses a method of forming piles on the surface of a flat plate-like substrate made of a sheet of synthetic resin by preparing a sheet of synthetic resin integrally with male engaging elements while introducing a sheet including a large number of long fibrous filaments arranged in parallel onto the peripheral surface of a heated drum having a large number of loop forming cavities to form loops arranged zig-zag and then combining it with the synthetic resin sheet so that a part of each of the loops made of the long fibrous filaments are fixed integrally to the surface of the synthetic resin sheet by fusing.

Japanese Patent Application Laid-Open No. 63-63405 also discloses a method in which the surface of a sheet of thermoplastic synthetic resin is softened and a sheet of knit or unwoven fabric carrying a large number of piles on the surface is pressed against and firmly attached to the thermoplastic synthetic resin sheet. Then, the softened material of the synthetic resin sheet permeates into the rear surface of the sheet of fabric and becomes integral part thereof to stabilize the profiles of the piles so that the obtained product does not require any back coat.

Finally, Japanese Patent Application Laid-Open No. 2-191735 discloses a method of forming a female engaging member comprising steps of feeding multifilaments of two different types having different melting points into a preliminary air twisting apparatus with different feed rates, producing a covered thread being heat-set by covering a core thread with a large number of looped fibers, arranging a plurality of such covered threads in parallel on a sheet of unwoven fabric and heat treating them at temperature higher than the melting point of the low melting point mutilfilaments but lower than that of the high melting point multifilaments to fuse the low melting point multifilaments to be integral with the surface of the sheet.

However, with the method of manufacturing a female engaging member disclosed in U.S. Pat. No. 5,512,234, it is difficult to bend the large number of multifilaments to be formed evenly and arranged zig-zag uniformly unless the tension applied to them when they are fed in parallel onto the drum is controlled highly accurately, and a plurality of operating members of the apparatus for forming the female engaging member have to be driven synchronously and quite accurately in order to firmly attach the filaments, maintaining the loops in shape onto the surface of the synthetic resin sheet. Thus, the manufacturing cost will be high and only limited types of products can be manufactured because the drum is costly and requires cumbersome operations for replacement so that the proposed method has limited applications.

A female engaging member as disclosed in Japanese Patent Application Laid-Open No. 63-63405 carries a thermoplastic resin sheet on the entire rear surface of the fabric instead of a back coat material, and a part of the material of the sheet permeates the sheet of fabric to get to the entire rear surface and becomes integral part thereof. Thus, the female engaging member is accompanied by a drawback of not being sufficiently soft and flexible because of the existence of the thermoplastic resin sheet and the rigidity that appears on the interface.

A female engaging member as disclosed in Japanese Patent Application Laid-Open No. 2-191735 is prepared by causing substantially untwisted multifilaments of two different types having different melting points to be "preliminarily twisted" by means of a whirling air flow, where the multifilaments arranged in parallel are made to pass through the whirling air flow and become intertwined randomly, heat setting them and thereafter melting the low melting point multifilaments at temperature between the two melting points of the multifilaments so that they are fused integrally with the substrate sheet (cover). Thus, a part of the low melting point multifilaments are fused to be integral with the substrate sheet and, since they are intertwined with the high melting point multifilaments randomly and become liquefied as being molten, the molten resin can easily be agglomerated at the crossings of high melting point multifilaments to bond the latter each other at the crossings.

As a result, however , the loops of the high melting point multifilaments that have been produced are reduced in size to make the female engaging elements on the female engaging member less apt to be engaged with male engaging elements and some of the female engaging elements may become totally unfunctional. If the function of the engaging elements is to be secured when the molten resin are agglomerated at the crossings of high melting point multifilaments, various parameters for producing the multifilaments of two different types to cross have to be controlled rigorously to involve difficulties in maintenance.

In view of the above identified problems, it is therefore the object of the present invention to provide a female engaging member of a surface fastener carrying engaging elements having a novel profile in which the engaging strength and the peeling resistance can be readily set, and which can be manufactured continuously by a relatively simple process without requiring serious maintenance efforts, and thus the engaging member has high productivity, and the manufacturing method of the engaging member.

SUMMARY OF THE INVENTION

According to the invention, the above object is achieved by providing a female engaging member of a surface fastener comprising a flat plate-like substrate and a large number of pile-shaped engaging elements arranged on the surface thereof, characterized by that the pile-shaped engaging elements are made of filaments wound around core threads and that a winding of each filament wound around a core thread has a length greater than that of the outer periphery of the core thread and that, when the pile-shaped engaging elements are firmly attached to the surface of the flat plate-like substrate, the largest gap D between the inner surface of each filament and the peripheral surface of the corresponding core thread is defined by $0.1\ \text{mm} \leqq D \leqq 5\ \text{mm}$.

Referring to FIG. 12 of the accompanying drawings, the largest gap D is the distance between the top P of the core thread firmly attached to the flat plate-like substrate and the intersection P' of the vertical line standing from the top P and the inner peripheral surface of the pile-shaped engaging element surrounding the core thread 13. While the gap D is determined in accordance with the profile of the mating male engaging element, the height H1 of the male engaging element from the substrate surface to the top of the engaging head of the male engaging element and the height H2 of the engaging head as defined by the distance between the top and the bottom of the engaging head are particularly important. Mating male engaging elements that can snugly engage the female engaging elements of a female engaging member according to the invention are required to show a ratio of H1:H2 between 2:1 and 5:1. If the ratio exceeds 5 and a pressure is exerted on the male and female engaging elements are pressed against each other and then the pressure is released, they can easily and elastically restore the standing position from their bent position and the male engaging elements become disengaged from the pile-shaped engaging elements quite easily so that the engaging force of the surface fastener will be significantly lost. If the ratio is smaller than 2, the engaging heads of the male engaging elements can hardly move into the loops of the female engaging elements so that the surface fastener can not provide a satisfactory engaging force.

The filaments wound around the core threads may be multifilaments or monofilaments. The core threads are preferably made of a material having a melting point lower than that of the filaments because it is necessary when yarns composed of the core threads and the filaments are fused onto the surface of the flat plate-like substrate. Preferably, the flat plate-like substrate is made of a fibrous sheet or a molded sheet made of thermoplastic resin and the filaments are firmly attached to the flat plate-like substrate as the core threads are molten. When the core threads have a melting point substantially equal to that of the other components, the yarns may be bonded to the surface of the flat plate-like substrate by means of an adhesive agent. Alternatively, the flat plate-like substrate may be a molded sheet made of thermoplastic resin and the filaments and the core threads may be firmly attached to the flat plate-like substrate that is still soft in the molding process by applying pressure to them.

Preferably, the core threads are made of thermally contractable fibrous material and the yarns are formed by twisting the filaments around core threads at a pitch corresponding to said gap D so that the core threads are heated and contracted to make the filaments close to each other before they are firmly attached to the flat plate-like substrate. The height of the looped helical filaments and the pitch can be regulated by controlling the contraction of the core threads.

Alternatively, the thermal contraction of the core threads may be replaced by displacement of the filaments in a direction along the core threads mechanically to make the filaments close to each other before they are firmly attached to the sheet of the flat plate-like substrate, the yarns being formed by twisting the filaments around core threads at a pitch corresponding to said gap D. In this case again, the height of the looped helical filaments and the pitch can be regulated by controlling the displacement of the filaments.

For the purpose of the invention, a large number of male engaging elements may be arranged on a surface of the flat plate-like substrate where the filaments are firmly attached thereto. Alternatively, a large number of male engaging elements may be arranged on a surface of the flat plate-like substrate opposite to the surface where the filaments are firmly attached thereto. In both cases, the flat plate-like substrate and the male engaging elements are preferably formed simultaneously.

According to the invention, there is also provided a method of manufacturing an engaging member of a surface fastener.

More specifically, there is provided a method of manufacturing a surface fastener comprising a flat plate-like substrate and a large number of pile-shaped engaging elements arranged on the surface thereof. The method is characterized in that it comprises steps of continuously feeding a continuous sheet member, arranging continuous parallel yarns consisted of monofilaments or multifilaments for forming the pile-shaped engaging elements as being wound continuously and helically around core therads to meet a surface of the sheet member and firmly attaching the yarns to the sheet member and that a winding of each filament wound around the core thread has a length greater than that of the outer periphery of the core thread and that, when the filaments are firmly attached to the surface of the flat plate-like substrate, the largest gap D between the inner surface of each filament and the peripheral surface of the corresponding core thread is defined by $0.1\ \text{mm} \leqq D \leqq 5\ \text{mm}$.

Preferably, the core threads are made of thermally contractible fibrous material and the method further comprises steps of forming the yarns by twisting the filament around each core thread at a pitch corresponding to the gap D before putting the yarns and the sheet member together and heating and contracting the core threads to make the filaments close to each other. Alternatively, the method may further comprises steps of forming the yarns by twisting the filament around each core thread at a pitch corresponding to the gap D and displacing the filaments mechanically in a direction along the core threads to make the filaments close to each other. As discussed above, the pitch of the looped helical filaments can be regulated by controlling the displacement of the filaments.

If the yarns are firmly attached to the sheet member and subsequently the yarns are buffed, in case that the filaments are multifilaments, the pile-shaped engaging elements of the filaments are extended in various directions to achieve an enhanced engaging rate with the mating male engaging elements.

If the sheet member is composed of a synthetic resin sheet or fabric and the core threads have a melting point lower than those of the sheet member and the filaments, the filaments can be attached to the sheet member by heating and melting the core threads. If there is no difference of melting points, they can be bonded integrally by adhesive agent. If the sheet member is composed of a synthetic resin sheet, the yarns are firmly attached to the sheet member that is molded and still soft by applying pressure to them.

Mating male engaging elements may be formed at the time of manufacturing the sheet member either on the front or rear surface thereof. If the sheet member is made of knit or woven fabric, the male engaging elements are made of monofilaments and knit or woven at the time of knitting or weaving of the sheet member. If, on the other hand, the sheet member is composed of a synthetic resin sheet, the male engaging elements may typically be molded integrally and simultaneously with the molding of the sheet member.

DETAILED DESCRIPTION OF THE PREFERRED EMBODIMENTS

Figure 1:
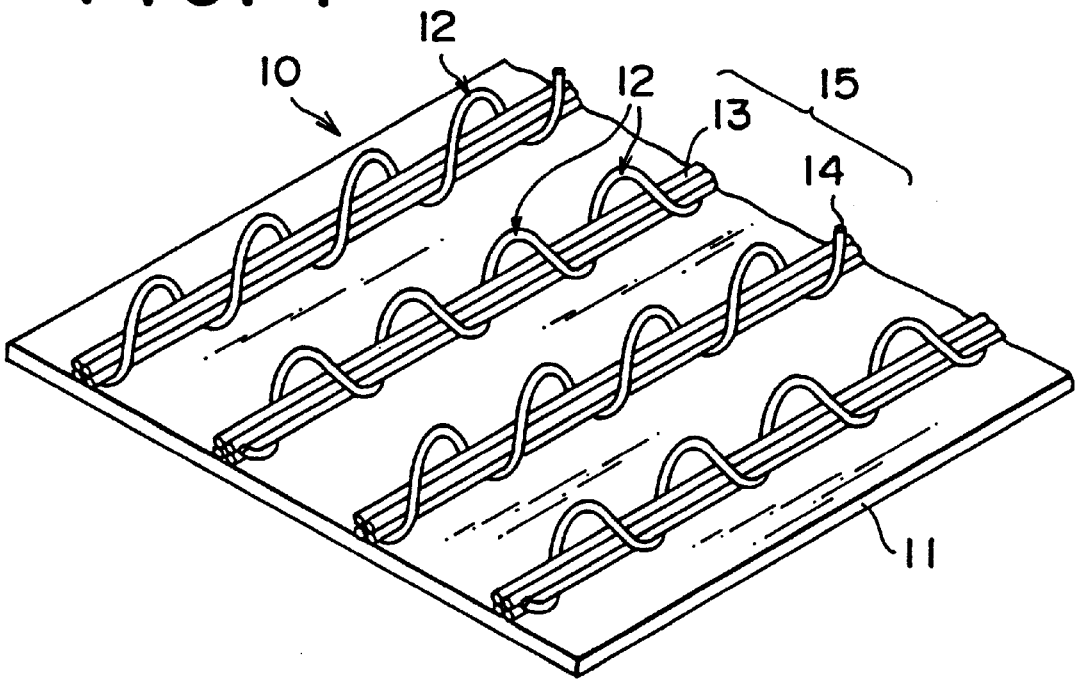
FIG. 1 is a schematic perspective view of a first embodiment of engaging member of a surface fastener according to the invention.
Figure 2:
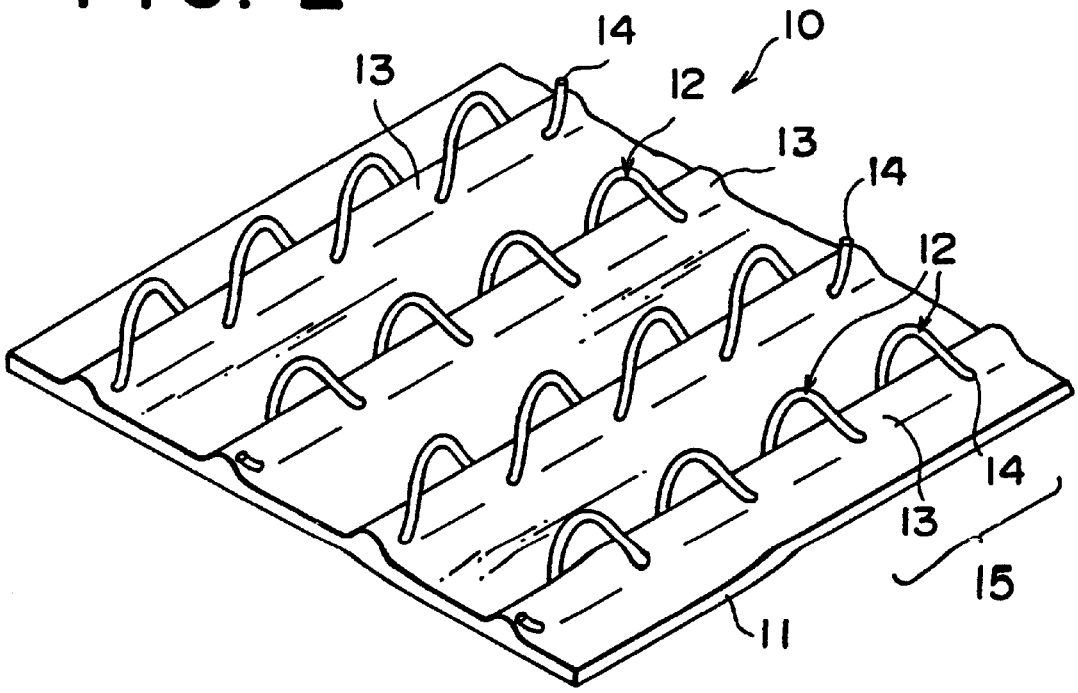
FIG. 2 is a schematic perspective view of a second embodiment of engaging member of a surface fastener according to the invention.
Figure 3:
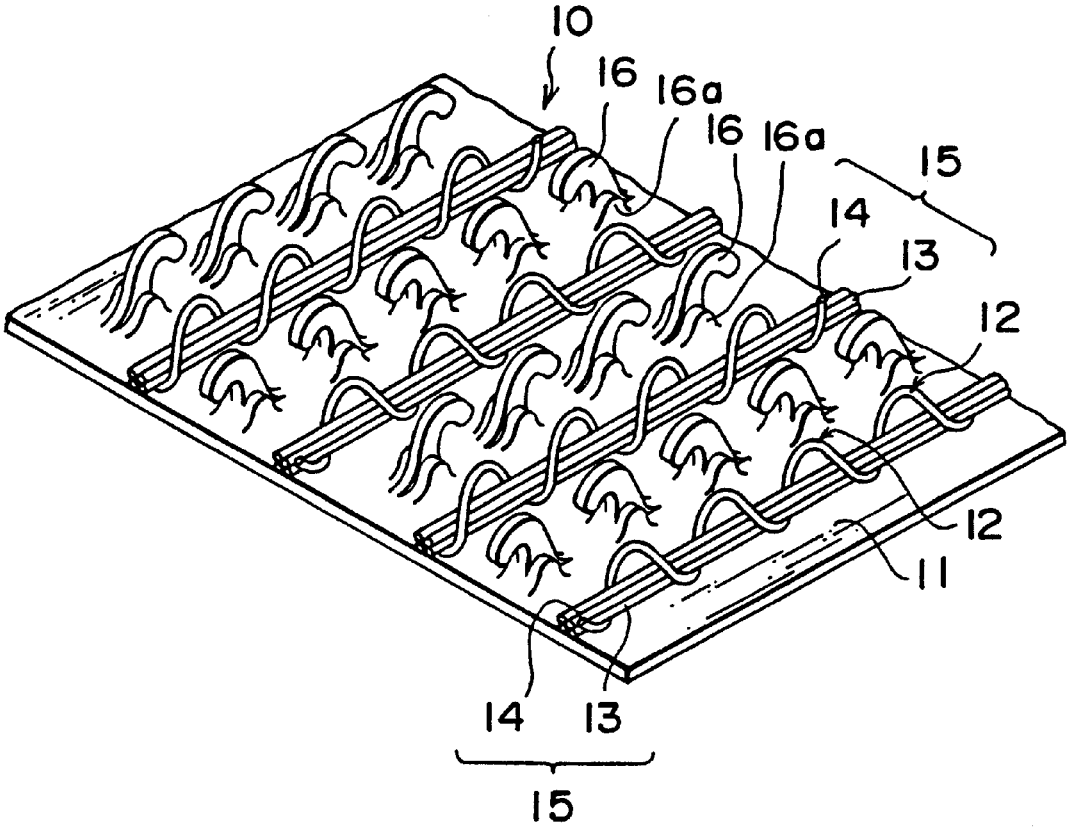
FIG. 3 is a schematic perspective view of a third embodiment of engaging member of a surface fastener according to the invention.
Figure 4:
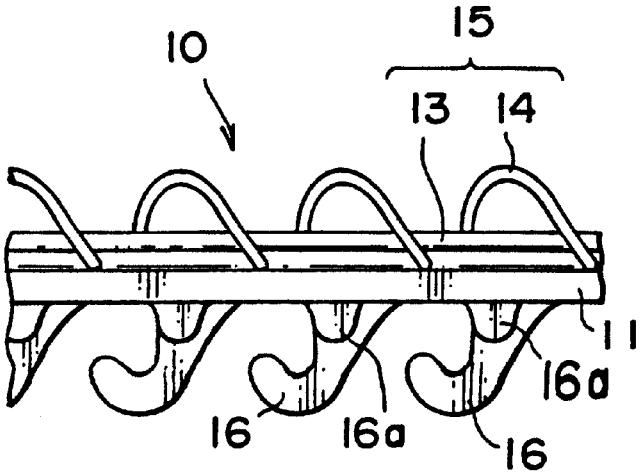
FIG. 4 is a schematic partial perspective view of a fourth embodiment of engaging member of a surface fastener according to the invention.

Now, the present invention will be described by referring to the accompanying drawings that illustrate typical embodiments of the invention. FIGS. 1 through 3 are schematic perspective views of three different embodiments of engaging member of a surface fastener according to the invention, carrying typical respective engaging elements. FIG. 4 is a side view of a fourth embodiment of engaging member of a surface fastener according to the invention. Note, however, that the present invention are not limited thereto and the illustrated embodiment of engaging member may be modified in various different ways without departing from the scope of the invention. For example, the pile-shaped engaging elements formed around respective core threads may be made of monofilaments.

Firstly the first embodiment of female engaging member 10 of a surface fastener according to the invention will be described by referring to FIG. 1. The female engaging member 10 comprises a flat plate-like substrate 11 made of thermoplastic synthetic resin and rows of pile-shaped engaging elements 12 arranged on the surface of the substrate 11. The present invention is characterized most by such pile-shaped engaging elements 12. While the pile-shaped engaging elements 12 are formed by multifilaments in this embodiment, they may be replaced by monofilaments.

The pile-shaped engaging elements 12 consists a part of a yarn 15. In the embodiment of FIG. 1, the yarn 15 is formed by core thread 13 of multifilament and outer multifilament 14 helically and continuously wound around the core thread. The pile-shaped engaging elements 12 are formed by the multifilaments 14.

While each multifilament 12 is shown as a single filament in FIG. 1 for the purpose of simplification, it is made of a large number of fine filaments arranged in parallel to produce a row of the yarn, like a typical female engaging element. Note that the helical loops are arranged at a pitch by far wider than the actual pitch. In reality, the helical loops of multifilaments 14 constituting the pile-shaped engaging elements are arranged at a pitch that is very small and hence they are arranged very densely. The thermoplastic synthetic resin material can be selected from materials including polyester, polyamide and polypropylene. Both the multifilaments 14 and the core threads 13 have a size (diameter) between 50 and 1,000d, preferably between 100 and 500d.

The engaging elements 12 and the core threads 13 of the yarn 15 are also made of the above-mentioned thermoplastic synthetic resin materials having necessary physical properties so that they may be combined in an advantageous fashion.

Figure 5:
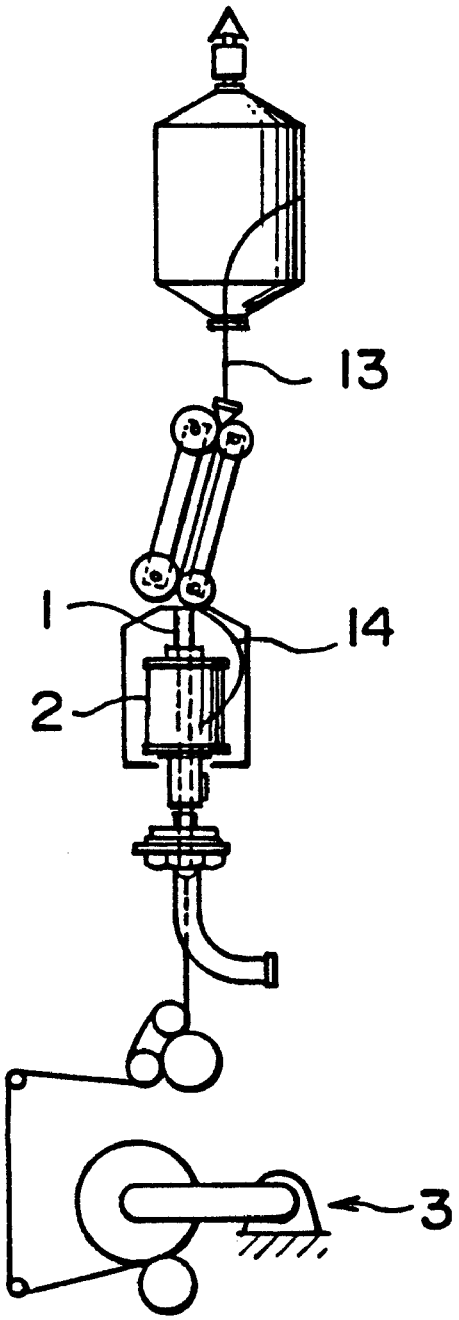
FIG. 5 is a schematic front view of an apparatus for producing a filament that can be used for manufacturing the surface fastener.

The yarn 15 can be formed easily by means of a known twisting method commonly used for hollow spindle spinning. For example, referring to FIG. 5, a multifilament to be used for the core thread 13 is made to pass through a hollow spindle 1, while another multifilament 14 wound around a revolving bobbin 2 and consisting the pile-shaped engaging elements 12 is fed and wound around the multifilament consisting the core thread 13 and then they are received by a take-up reel 3. With this method, the pitch of helically arranging pile-shaped engaging elements 12 around the core thread 13 can be determined by selecting the rate of feeding the core thread 13 and the rate of revolution of the bobbin 2. More specifically, if a relatively large value is selected for the rate of feeding the core thread 13 and the rate of revolution of the bobbin 2 is made low, the pitch will show a large value. The final size of the piles is determined by the pitch because the length of each wrap of the multifilament 14 around the core thread 13 for forming a pile-shaped engaging element 12 is also determined by the pitch.

Figure 6:
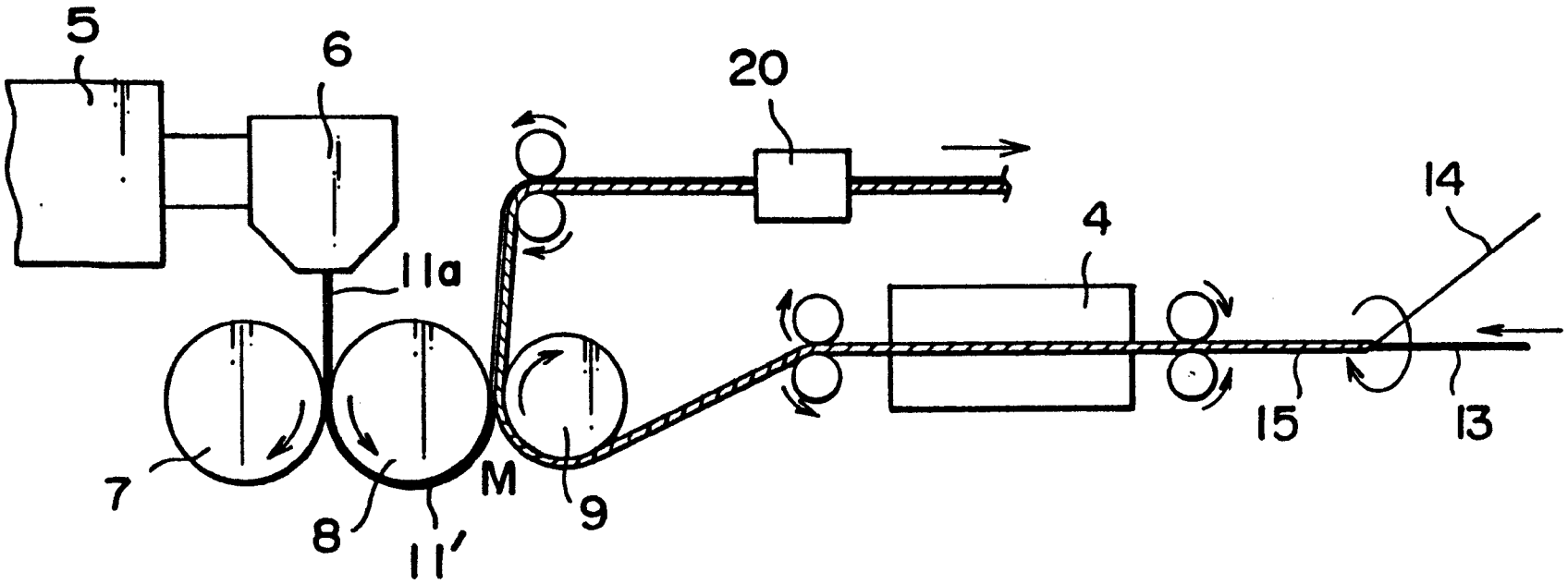
FIG. 6 is a schematic view of a main part of process for manufacturing an engaging member of a surface fastener according to the invention, showing a principal step thereof.

The yarn 15 is then processed appropriately and the multifilaments 14 for forming pile-shaped engaging elements 12 are converged longitudinally of the respective core threads 13 so that adjacently located pile-shaped engaging elements 12 are made to stand. This operation of converging helical multifilaments 14 can be realized by selecting a shrinkable material for the core threads 13 and causing the core threads 13 to contract by means of boiling water or dry hot air. Alternatively, it may be realized by scraping the multifilaments 14 consisting the pile-shaped engaging elements 12 in a direction along the core threads by means of a fork-shaped scraper (not shown) that is driven to move in that direction. After the converging process, a plurality of the yarns 15 are arranged in parallel relative to each other at regular intervals. Then, they are moved to a flat plate-like sheet member 11' being fed from a roll at a constant rate in order to put them together as shown in FIG. 6. In the illustrated example, when the plurality of yarns 15 are moved to the continuous sheet member 11', the multifilaments 14 of the pile-shaped engaging elements 12 of the yarns 15 are S-twisted and Z-twisted alternately. If the core threads 13 are made of contractable filaments and said contracting process and said heat setting process can be conducted concurrently, the take-up reel 3 may be omitted in the process of preparing the yarn 15 of multifilaments and the heat setting apparatus 4 may be arranged between the junction M of the continuous sheet member 11' and the yarns 15 of multifilaments and the station of producing the yarns 15 shown in FIG. 5. Of course, alternatively, yarns 15 of converged multifilaments may be formed independently and fed to the junction M where it is combined with the continuous sheet member 11'. After they are put together, the yarns 15 of multifilaments are firmly attached to the continuous sheet member 11' at the junction M by an appropriate means selected by various feasible means.

With the above embodiment, since the flat plate-like substrate 11 is made of thermoplastic synthetic resin and the continuous sheet member 11' and the yarns 15 of multifilaments are firmly attached to each other at the junction M by applying the yarns of multifilaments onto the surface of the continuous sheet member 11' that is still soft under pressure. In the illustration of FIG. 6, the continuous flat plate-like substrate 11' is produced as a flat strip of molten resin 11*a* extruded from an extruder 5 and made to pass through a die 6 is introduced into the gap between a pair of cooling rollers 7, 8 to produce the flat plate-like substrate 11 having a predetermined thickness before it is carried on the peripheral surface of the cooling roller 8 by a half turn of the roller 8 and cooled to a softened state so that the flat plate-like substrate 11 may be combined with the yarns 15 of multifilaments at the Junction M, which is located in the gap between the cooling roller 8 and a press roller 9 arranged opposite to the cooling roller 8.

With this embodiment, the continuous sheet member 11' and the yarns 15 of multifilaments secured to each other at the junction M are then fed to a buffing station 20 by way of guide rollers. Of course, the buffing step can be omitted when the pile-shaped engaging elements 12 are made of monofilaments.

Figure 7:
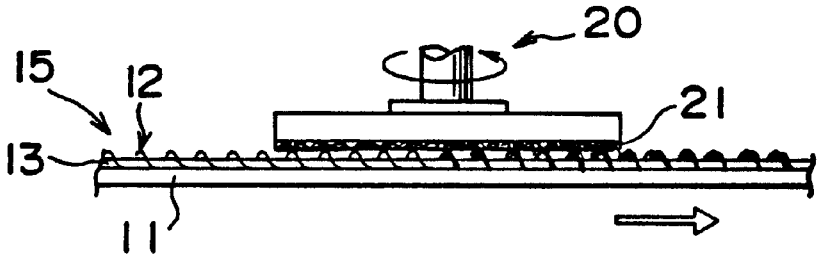
FIG. 7 is a schematic view of the process of manufacturing an engaging member of a surface fastener according to the invention, showing a buffing step thereof.

At the buffing station 20, a disc made of felt 21 is arranged such that it is held in contact with the surface of the yarns 15 of multifilaments firmly attached to the continuous sheet member 11' that is being fed in to scrape the surface of the pile-shaped engaging elements 12 of the yarns 15 therewith and spread the piles of multifilaments of the pile-shaped engaging elements 12 in different directions as shown in FIG. 7, which piles of multifilaments are then heat treated to stably maintain the spread profiles thereof. The sheet member 11' carrying the yarns 15 of multifilaments as integral part thereof is then received by a take-up reel (not shown) and cut to sheets having a predetermined length to produce a number of engaging members 10 comprising the flat plate-like substrate 11 and the large number of pile-shaped engaging elements 12 arranged on the surface thereof as shown in FIG. 1.

FIG. 2 shows a second embodiment of the engaging member 10 of the surface fastener according to the invention. While the flat plate-like substrate 11 of this embodiment is made of a thermoplastic synthetic resin material same as that of the first embodiment, the core threads 13 are made of a material having a melting point lower than that of the remaining components of the engaging member, and having affinity with the flat plate-like substrate 11. These requirements may be met by using polyamide resin materials with different melting points for the substrate 11 and the core threads 13 respectively and a polyester resin material for the multifilaments consisting the pile-shaped engaging elements 12.

The second embodiment of engaging member may be manufactured in a manner as will be described below. Firstly, the sheet member 11' carrying the yarns 15 as integral part thereof and obtained as in the case of the first embodiment is fed to a heating station (not shown). In the heating station, the sheet member 11' carrying the yarns 15 are heated by infrared rays to temperature higher than the melting point of the core threads 13 but lower than the melting points of the remaining components including the sheet member 11' and the multifilaments 14 consisting the pile-shaped engaging elements 12. When the sheet member 11' carrying the yarns 15 as integral part thereof is made to pass through this station and cooled in a downstream cooling station (not shown), the core threads 13 are molten and flows onto the surface of the flat plate-like substrate 11 to produce a large adhering area. The molten resin also penetrates into spaces among the multifilaments 14 consisting the pile-shaped engaging elements 12 to firmly adhere the filaments to the surface of the flat plate-like substrate 11.

The third embodiment of engaging member 10 of a surface fastener according to the invention, illustrated in FIG. 3, comprises the flat plate-like substrate 11 and the pile-shaped engaging elements 12 arranged on the surface of the substrate 11 along with hook-shaped engaging elements 16 arranged on the same surface where the pile-shaped engaging elements 12 are located. More specifically, the hook-shaped engaging elements 16 are molded simultaneously with the flat plate-like substrate 11 and arranged between any adjacent rows of the yarns 15 on the same surface of the flat plate-like substrate 11 on which the plurality of yarns 15 are provided in parallel as shown in FIG. 1. With this embodiment, each of the hook-shaped engaging elements 16 is provided with a pair of reinforcement ribs 16*a*, 16*a* arranged on the opposite lateral sides thereof.

Figure 8:
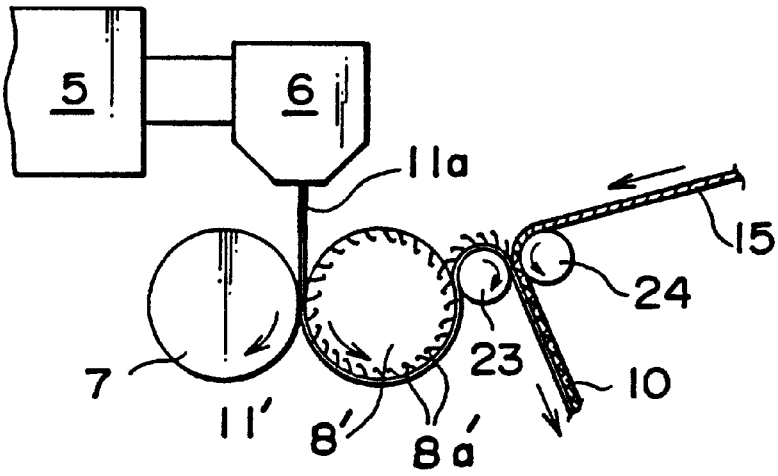
FIG. 8 is a schematic view of a method for manufacturing an engaging member of a surface fastener according to the invention, carrying female and male engaging elements on the same side of the flat plate-like substrate.

The third embodiment of engaging member may be manufactured in a manner as will be described below. Firstly, as shown in FIG. 8, a continuous flat strip of molten resin 11*a* is extruded from an extruder 5 and made to pass through a die 6 and is then introduced into the gap between a pair of cooling rollers 7, 8' to produce a sheet member 11' having a predetermined thickness, while the molten resin 11*a* is partly pushed into hook-shaped cavities 8*a*' formed on the peripheral surface of the cooling roller 8' to mold hook-shaped engaging elements 16 integrally on a surface of the sheet member 11'. The sheet member 11' carrying the hook-shaped engaging elements 16 as integral part thereof is then carried on the peripheral surface of the cooling roller 8' by a half turn of the roller 8' and cooled to a softened state and received by a take-up roller 23 from the cooling roller 8'. The yarns 15 are introduced between the take-up roller 23 and a press roller 24 arranged opposite to the take-up roller 23 while the sheet member 11' is moved on the peripheral surface of the take-up roller 23. The yarns 15 are arranged and aligned such that each of the yarn 15 is introduced between a pair of adjacently located rows of hook-shaped engaging elements 16 on the surface of the sheet member 11'.

FIG. 4 shows a fourth embodiment of engaging member of a surface fastener according to the invention. As seen from FIG. 4, the hook-like engaging elements 16 of this embodiment are arranged on a surface of the flat plate-like substrate 11 opposite to the one where pile-shaped engaging elements 12 are formed. This engaging member of a surface fastener can be manufactured as in the case of the first embodiment but by forming hook-shaped cavities 8*a*' on the peripheral surface of the cooling roller 8 as shown in FIG. 8 and introducing the yarns 15 to the junction M between the cooling roller 8 and the take-up roller 23.

Figure 9:
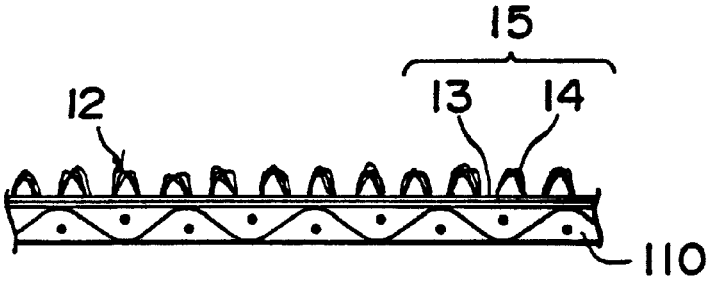
FIG. 9 is a schematic cross sectional view of a structural example of a flat plate-like substrate of an embodiment of engaging member of a surface fastener according to the invention, which is made of fabric.
Figure 10:
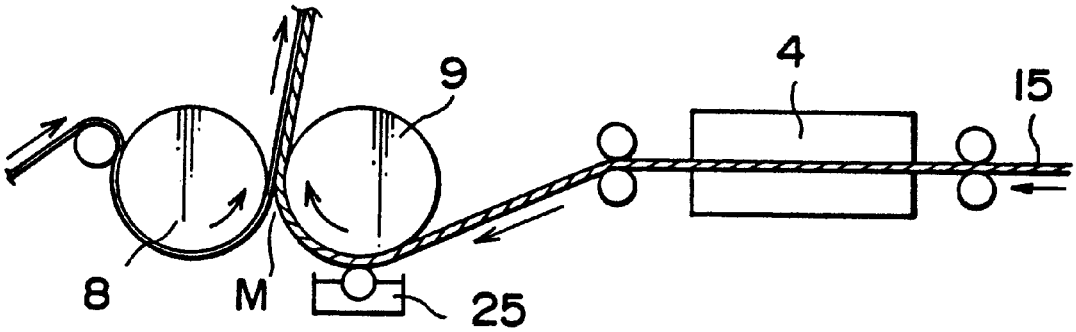
FIG. 10 is a schematic view of an example of a process for manufacturing an engaging member of a surface fastener according to the invention.

While the flat plate-like substrate 11 is a molded sheet prepared by molding a thermoplastic synthetic resin material in each of the above embodiments, the flat plate-like substrate may alternatively be made of knit or woven fabric or non-woven fabric as shown in FIG. 9. If such is the case, the core threads 13 of the yarns 15 are preferably made of a material having a melting point lower than that of the material of other components so that the yarns 15 are firmly attached to a flat plate-like substrate 110 by the resin material of the core threads 13 when the latter are heated and molten. Alternatively, the yarns 15 may be bonded to the flat plate-like substrate 110 by means of an adhesive agent.

When the yarns 15 are bonded to the flat plate-like substrate 110 by means of the adhesive agent, an adhesive applicator 25 is arranged between the heat setting apparatus 4 and the junction M and the adhesive agent is applied to part of the yarns 15 before the latter is fed to the junction M. When male engaging elements are arranged simultaneously as in the case of the third and fourth embodiments, monofilaments to be used for forming the male engaging elements are knit or woven to form loops at the time of knitting or weaving the fabric and thereafter loops are cut to produce hook-shaped or mushroom-shaped male engaging elements in a known manner.

Figure 11:
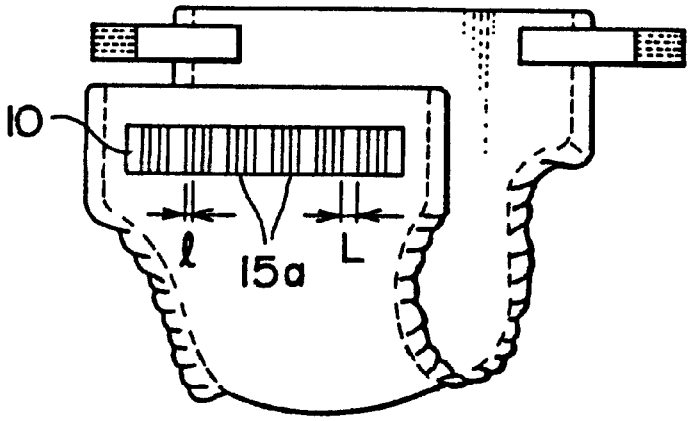
FIG. 11 is a schematic perspective view of a paper nappy provided with an engaging member of a surface fastener according to the invention, showing the positional relationship between the flat plate-like substrate and the filaments of the engaging member.
Figure 12:
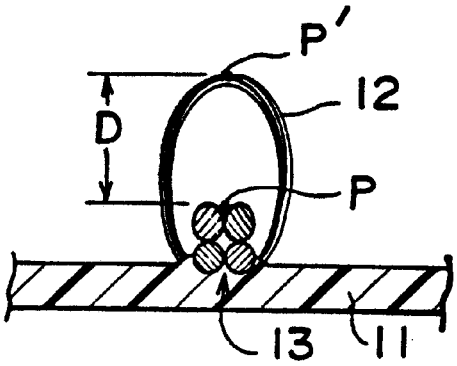
FIG. 12 is a schematic cross sectional view of a female engaging member of a surface fastener according to the invention, illustrating the gap D between the top of a core thread and the highest portion of the inner periphery of a corresponding pile-shaped engaging element.
Figure 13A:
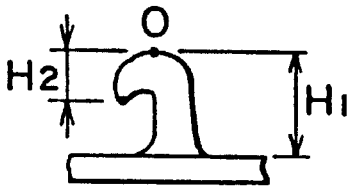
FIGS. 13A through 13E are schematic views of companion male engaging elements, showing the heights H1 and H2 thereof.
Figure 13B:
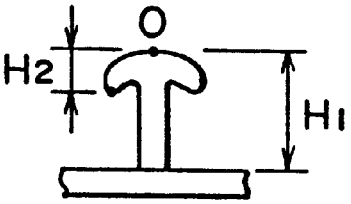
Figure 13C:
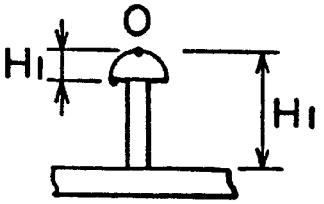
Figure 13D:
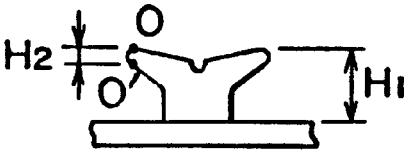
Figure 13E:
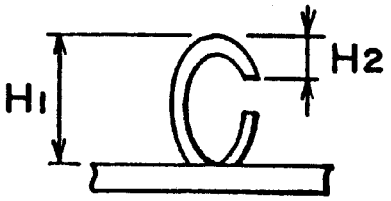

FIG. 11 shows an example, illustrating positional arrangement of the yarns 15 relative to the flat plate-like substrate 11, 110. While the yarns 15 are arranged at regular intervals 1 as shown in FIGS. 1 through 3, the yarns 15 may be arranged into a plurality of groups of yarns (four in FIG. 11) 15*a* which are spaced apart from each other with an interval L greater than the interval 1. With this arrangement of the yarns 15, the interval L serves as scale so that when an engaging member according to the invention is applied to a paper nappy, the size of the nappy can be classified by means of the gap L and standards may be provided to control nappies of different sizes by defining values for the gap L.

It may be appreciated that the above embodiments may be modified appropriately in many different ways without departing from the scope and the spirit of the invention.

As may be understood from the above description, an engaging member 10 of the surface fastener according to the invention can be manufactured at low cost on a continuous basis to reduce the man power necessary for manufacturing and raise the productivity. Additionally, since the pile-shaped engaging elements 12 are fixed in parallel at regular intervals onto the flat plate-like substrate 11, 110, the substrate 11, 110 can remain flexible without the risk of becoming rigid. Still additionally, since the pile-shaped engaging elements 12 are sandwiched between the core threads 13 and the flat plate-like substrate 11, 110 and firmly attached to the substrate 11, 110, the engaging member 10 makes the surface fastener highly durable.

In the engaging member 10 of the surface fastener according to the invention, in addition to the pile-shaped engaging elements 12, hook-shaped engaging elements 16 that can be engaged with and disengaged from the pile-shaped engaging elements 12 can be easily provided on the same substrate, it can be applied to manufacture known binding bands.

Still additionally, in the engaging member 10 of the surface fastener according to the invention, when Z-twisted multifilaments and S-twisted multifilaments have yarns 15 for pile-shaped engaging elements 12 are arranged alternately on the substrate 1, the adjacent rows of pile-shaped engaging elements 12 are directed differently to make the engaging member engageable in different directions and enhance the stability of engagement.

Finally, according to the method of manufacturing an engaging member of a surface fastener according to the invention, it is possible to manufacture the engaging members 10 of the surface fasteners continuously so that it is excellent in productivity, and further since manufacturing can be realized by combining existing equipment, the method is quite advantageous in view of the cost and control.

What is claimed is:

1. A female engaging member for a surface fastener comprising a flat plate-like substrate and a large number of pile-shaped engaging elements arranged on the surface thereof for surface engagement with a mating male engaging member for a surface fastener, wherein said pile-shaped engaging elements are made of filaments wound around a core thread and that a winding of each filament wound around said core thread has a length greater than that of the outer periphery of the core thread and wherein the flat plate-like substrate and the core thread are moltenly integral with each other.

2. A female engaging member for a surface fastener according to claim 1, wherein the filaments wound around the core threads are multifilaments.

3. A female engaging member for a surface fastener according to claim 1, wherein the filaments wound around the core threads are monofilaments.

4. A female engaging member for a surface fastener according to claim 1, wherein the core threads are made of a material having a melting point lower than the melting point of said flat plate-like substrate and that of the filaments.

5. A female engaging member for a surface fastener according to claim 4, wherein the flat plate-like substrate is made of a fibrous sheet and said filaments are firmly attached to the flat plate-like substrate when the core threads are in a molten state.

6. a female engaging member for a surface fastener according to claim 4, wherein the flat plate-like substrate is a molded sheet made of thermoplastic resin and said filaments are firmly attached to the flat plate-like substrate when the core threads are in a molten state.

7. A female engaging member for a surface fastener according to claim 1, wherein the flat plate-like substrate is a molded sheet made of thermoplastic resin and the filaments and the core threads are firmly attached to the flat plate-like substrate when the flat plate-like substrate is in a soft state in the molding process by applying pressure to them.

8. A female engaging member for a surface fastener according to claim 1, wherein said core threads are made of thermally contractible fibrous material and said filament is twisted around each said core thread at a pitch corresponding to a gap between the inner surface of each filament and the peripheral surface of the corresponding thread so that the core threads are heated and contracted to make the filaments close to each other before they are firmly attached to the flat plate-like substrate.

9. A female engaging member for a surface fastener according to claim 1, wherein said filament is twisted around each said core thread at a pitch corresponding to a gap between the inner surface of each filament and the peripheral surface of the corresponding thread and the filaments are displaced in a direction along the core threads to make the filaments close to each other before they are firmly attached to the flat plate-like substrate.

10. A female engaging member for a surface fastener according to claim 1, wherein a large number of male engaging elements are arranged on a surface of the flat plate-like substrate where said filaments are firmly attached thereto.

11. A female engaging member for a surface fastener according to claim 1, wherein a large number of male engaging elements are arranged on a surface of the flat plate-like substrate opposite to the surface where said filaments are firmly attached thereto.

12. A female engaging member for a surface fastener according to claim 1, wherein said flat plate-like substrate and a large number of male engaging elements are formed simultaneously.

13. A female engaging member for a surface fastener according to claim 1, wherein when the pile-shaped engaging elements are firmly attached to the surface of the flat plate-like substrate, the largest gap D between the inner surface of each filament and the peripheral surface of the corresponding core thread is defined by $0.1\ \text{mm} \leqq D \leqq 5\ \text{mm}$.

14. A method of manufacturing a female engaging member for a surface fastener comprising a flat plate-like substrate and a large number of pile-shaped engaging elements arranged on the surface thereof, said method comprising the steps of:

continuously feeding a continuous sheet member;

arranging continuous parallel yarns consisted of monofilaments or multifilaments for forming said pile-shaped engaging elements as being wound continuously and helically around core threads to meet a surface of said sheet member continuously;

firmly attaching said yarns to said sheet member;

melting the flat plate-like substrate and the core thread to be integral with each other; and wherein a winding of each filament wound around the core thread has a length greater than that of the outer periphery of the core thread.

15. A manufacturing method according to claim 14, wherein said core threads are made of thermally contractible fibrous material and the method further comprises steps of:

forming said yarns by twisting said filament around each said core thread at a pitch corresponding to a gap between the inner surface of each filament and the peripheral surface of the corresponding thread before putting said yarns and said sheet member together; and heating and contracting the core threads to make the filaments close to each other.

16. A manufacturing method according to claim 14, wherein it further comprises steps of:

forming said yarns by twisting said filament around each said core thread at a pitch corresponding to a gap between the inner surface of each filament and the peripheral surface of the corresponding thread before putting said yarns and said sheet member together; and displacing the filaments mechanically in a direction along the core threads to make the filaments close to each other before they are firmly attached to the sheet member.

17. A manufacturing method according to claim 14, wherein the yarns are firmly attached to said sheet member and subsequently the yarns are buffed.

18. A manufacturing method according to claim 14, wherein the sheet member is composed of a synthetic resin sheet or fabric and the core threads have a melting point lower than those of the sheet member and the filaments;

the filaments being attached to the sheet member by heating and melting the core threads.

19. A manufacturing method according to claim 14, wherein the sheet member is composed of a synthetic resin sheet and the yarns are firmly attached to the sheet member that is molded and still soft by applying pressure to them.

20. A manufacturing method according to claim 14, wherein mating male engaging elements are formed at the time of manufacturing the sheet member either on the front or rear surface thereof.

21. A manufacturing method according to claim 20, wherein the sheet member is made of knit or woven fabric and the male engaging elements are made of monofilaments and knit or woven at the time of knitting or weaving of the sheet member.

22. A manufacturing method according to claim 20, wherein the sheet member is composed of a synthetic resin sheet and the male engaging elements are molded simultaneously and integrally with the sheet member.

23. A manufacturing method according to claim 14, wherein when the filaments are firmly attached to the surface of the flat plate-like substrate the method further comprises the step of forming a largest gap D between the inner surface of each filament and the peripheral surface of the corresponding core thread defined by 0.1 mm≦D≦5 mm.

24. A female engaging member for a surface fastener comprising a flat plate-like substrate and a large number of pile-shaped engaging elements arranged on the surface thereof for surface engagement with a mating male engaging member for a surface fastener, wherein said pile-shaped engaging elements are made of filaments wound around a core thread and that a winding of each filament wound around said core thread has a length greater than that of the outer periphery of the core thread and wherein said filament is twisted around each said core thread at a pitch corresponding to a gap between the inner surface of each filament and the peripheral surface of the corresponding thread and the filaments are located along the core threads to make the filaments close to each other before they are firmly attached to the flat plate-like substrate.

25. A method of manufacturing a female engaging member for a surface fastener comprising a flat plate-like substrate and a large number of pile-shaped engaging elements arranged on the surface thereof, said method comprising the steps of:

continuously feeding a continuous sheet member;

arranging continuous parallel yarns consisted of monofilaments or multifilaments for forming said pile-shaped engaging elements as being wound continuously and helically around core threads to meet a surface of said sheet member continuously;

firmly attaching said yarns to said sheet member;

forming said yarns by twisting said filament around each said core thread at a pitch corresponding to a gap between the inner surface of each filament and the peripheral surface of the corresponding thread before putting said yarns and said sheet member together; and locating the filaments along the core threads to make the filaments close to each other before they are firmly attached to the sheet member;

wherein a winding of each filament wound around the core thread has a length greater than that of the outer periphery of the core thread.

* * * * *